US010943539B1

(12) United States Patent
Liu et al.

(10) Patent No.: US 10,943,539 B1
(45) Date of Patent: Mar. 9, 2021

(54) DRIVING METHOD OF ACTIVE MATRIX ORGANIC LIGHT-EMITTING DIODE (AMOLED) DISPLAY PANEL AND DISPLAY DEVICE

(71) Applicant: Wuhan China Star Optoelectronics Semiconductor Display Technology Co., Ltd., Hubei (CN)

(72) Inventors: Minlun Liu, Guangdong (CN); Weinan Yan, Guangdong (CN); Qibing Dai, Guangdong (CN); Dan Lin, Guangdong (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 400 days.

(21) Appl. No.: 16/095,459

(22) PCT Filed: Feb. 12, 2018

(86) PCT No.: PCT/CN2018/076549
§ 371 (c)(1),
(2) Date: Oct. 22, 2018

(87) PCT Pub. No.: WO2019/127874
PCT Pub. Date: Jul. 4, 2019

(30) Foreign Application Priority Data

Dec. 28, 2017 (CN) ..... 201711460659.5

(51) Int. Cl.
*G09G 3/3258* (2016.01)
*G09G 3/20* (2006.01)

(52) U.S. Cl.
CPC ..... *G09G 3/3258* (2013.01); *G09G 3/2003* (2013.01); *G09G 3/2007* (2013.01); (Continued)

(58) Field of Classification Search
CPC ..... G09G 3/2003; G09G 3/006; G09G 2320/0233; G09G 2320/0242; (Continued)

(56) References Cited

U.S. PATENT DOCUMENTS

2013/0033526 A1* 2/2013 Hsu ..... G09G 3/2003 345/690
2017/0013351 A1* 1/2017 Lee ..... H04R 1/28
2019/0129295 A1* 5/2019 Li ..... G03B 21/00

* cited by examiner

*Primary Examiner* — Md Saiful A Siddiqui
(74) *Attorney, Agent, or Firm* — Leong C. Lei

(57) ABSTRACT

The present disclosure relates to an driving method of an active matrix organic light-emitting diode (AMOLED) display panel, including: calculating a first proportion group and a second proportion group corresponding to each of color channels in display images of the AMOLED display panel at the first moment and the second moment, determining whether the first proportion group and the second proportion group are the same, calculating a theoretical current value corresponding to a target color channel to maintain a predetermined display brightness, obtaining an actual current value transmitted by the current detector, comparing the actual current value with the theoretical current value by the comparator, obtaining a target driving voltage value corresponding to a target proportion in the second proportion group when the actual current value is greater than the theoretical current value, adjusting a driving voltage provided by the PMIC power supply to the target drive voltage.

20 Claims, 6 Drawing Sheets

(52) U.S. Cl.
CPC ..... *G09G 2320/0626* (2013.01); *G09G 2330/023* (2013.01); *G09G 2360/12* (2013.01); *G09G 2360/16* (2013.01)

(58) Field of Classification Search
CPC ... G09G 2320/0666; G09G 2320/0693; G09G 3/3258; G09G 3/2007; G09G 2320/0626; G09G 2360/16; G09G 2360/12; G09G 2330/023
See application file for complete search history.

DRIVING METHOD OF ACTIVE MATRIX ORGANIC LIGHT-EMITTING DIODE (AMOLED) DISPLAY PANEL AND DISPLAY DEVICE

CROSS REFERENCE TO RELATED APPLICATIONS

This application is a National Phase of International Application Number PCT/CN2018/076549, filed Feb. 12, 2018, and claims the priority of Chinese Patent Application No. 201711460659.5, entitled "DRIVING METHOD OF ACTIVE MATRIX ORGANIC LIGHT-EMITTING DIODE (AMOLED) DISPLAY PANEL AND DISPLAY DEVICE", filed on Dec. 28, 2017, the disclosure of which is incorporated herein by reference in its entirety.

BACKGROUND

1. Technical Field

The present disclosure relates to display field, more particularly to a driving method of an active matrix organic light-emitting diode (AMOLED) display panel and a display device.

2. Description of Related Art

As environmental awareness has become more and more important, the demand for energy conservation also becomes more and more important. The liquid crystal display (LCD) devices, commonly used in daily life, are gradually replaced by the active-matrix organic light emitting diode (AMOLED) display devices. The AMOLED display devices have the attributes, such as larger color saturation, wider color gamut, high contrast ratio, high high-dynamic range (HDR) image quality, faster response speed, may be manufactured as flexible display devices, and may have more flexible design space. When comparing to the LCD devices, the AMOLED display devices have advantages, such as greater performance in dark-state images, black-color displaying is dark enough, and less power consuming. However, in the bright-state images displaying, the AMOLED display devices may consume more power than LCD devices.

The AMOLED display device is of the active-matrix display type. The OLEDs capable of emitting red light, green light, and blue light are arranged in array, and various colors of light are emitted by adjusting the ratio of the three primary colors. When a brighter picture is displayed, especially when a white picture is displayed, the luminescent material reaches a maximum brightness value, resulting in higher power consuming. Therefore, how to reduce the power consuming of the OLED to achieve energy conservation under the premise of ensuring the display performance of the AMOLED display devices is a technical problem urgently to be solved in this technical field.

SUMMARY

In one aspect, the present disclosure relates to a driving method of an active matrix organic light-emitting diode (AMOLED) display panel configured to drive a driving device of an AMOLED display panel, the driving device includes: a controller including at least one random access memory (RAM) and a comparator, a current detector, a power management integrated circuit (PMIC) power supply, and the AMOLED display panel, the method including: obtaining display data stored within the RAM by the controller, wherein the display data includes a first displaying data field obtained from the RAM at a first moment and a second displaying data field obtained from the RAM at a second moment, and the first moment is earlier than the second moment; calculating a first proportion group corresponding to each of color channels in display images of the AMOLED display panel at the first moment and calculating a second proportion group corresponding to each of the color channels in the display images of the AMOLED display panel at the second moment according to the display data by the controller, wherein the color channels include a red color channel, a green color channel, and a blue color channel; determining whether the first proportion group and the second proportion group are the same by the controller; calculating a theoretical current value corresponding to a target color channel to maintain a predetermined display brightness according to the second displaying data field by the controller when the first proportion group is the same with the second proportion group, wherein the target color channel is any one of the red color channel, the green color channel, and the blue color channel; obtaining an actual current value transmitted by the current detector, wherein the actual current value corresponds to the target color channel in the AMOLED display panel at the second moment; comparing the actual current value with the theoretical current value by the comparator; obtaining a target driving voltage value corresponding to a target proportion in the second proportion group by the controller when the actual current value is greater than thetheoretical current value, wherein the target proportion corresponds to the target color channel; adjusting a driving voltage provided by the PMIC power supply to the target drive voltage by the controller, so as to drive the AMOLED display panel to operate according to the target drive voltage.

In another aspect, the present disclosure further relates to a driving device of an AMOLED display panel, including: a controller including at least one RAM and a comparator, a current detector, a PMIC power supply, and the AMOLED display panel, wherein the controller connects to the current detector, the PMIC power supply, and the AMOLED display panel, the current detector connects to the PMIC power supply and the AMOLED display panel, the PMIC power supply connects to the AMOLED display panel, the RAM connects to the AMOLED display panel, and the comparator connects to the current detector; wherein the RAM is configured to store display data of display images of the AMOLED display panel, the display data includes a first displaying data field obtained from the RAM at a first moment and a second displaying data field obtained from the RAM at a second moment, and the first moment is earlier than the second moment; the controller is configured to obtain display data stored within the RAM; the controller is further configured to calculate a first proportion group corresponding to each of color channels in the display images of the AMOLED display panel at the first moment and a second proportion group corresponding to each of the color channels in the display images of the AMOLED display panel at the second moment according to the display data, wherein the color channels include a red color channel, a green color channel, and a blue color channel; the controller is further configured to determine whether the first proportion group and the second proportion group are the same, if the first proportion group is the same with the second proportion group, the controller is configured to calculate a theoretical current value corresponding to a target color channel to maintain a predetermined display brightness according to the second displaying data field, wherein the target color channel is any one of the red color channel, the green color channel, and the blue color channel; the current detector is configured to detect an actual current value corresponding to the target color channel in the AMOLED display panel at the second moment; the comparator is configured to compare the actual current value with the theoretical current value; if the actual current value is greater than the theoretical current value, the controller is configured to obtain a target driving voltage value corresponding to a target proportion in the second proportion group, wherein the target proportion corresponds to the target color channel, the controller is further configured to adjust a driving voltage provided by the PMIC power supply to the target drive voltage, so as to drive the AMOLED display panel to operate according to the target drive voltage; and the PMIC power supply is configured to provide the driving voltage.

In another aspect, the present disclosure further relates to a computer-readable storage medium configured to store at least one computer program, wherein a computer conducts the computer programs to perform the driving method described in above.

In another aspect, the present disclosure further relates to a computer program product, including a non-transitory computer-readable storage medium configured to store at least one computer program, wherein a computer conducts the computer programs to perform the driving method described in above.

In view of the above, the controller is configured to obtain the display data stored within the RAM. The display data may include the first displaying data field obtained from the RAM at the first moment and the second displaying data field obtained from the RAM at the second moment. The first moment is earlier than the second moment. The controller is configured to calculate the first proportion group corresponding to each of the color channels in the display images of the AMOLED display panel at the first moment and the second proportion group corresponding to each of the color channels in the display images of the AMOLED display panel at the second moment according to the display data. The color channels may include the red color channel, the green color channel, and the blue color channel. The controller is configured to determine whether the first proportion group and the second proportion group are the same. If the first proportion group is the same with the second proportion group, it may indicate that the proportion of each of the color channels in the display images of the AMOLED display panel has not been changed during the specified time period. The controller is configured to calculate the theoretical current value corresponding to the target color channel to maintain the predetermined display brightness according to the second displaying data field. The target color channel may be any one of the red color channel, the green color channel, and the blue color channel. The controller is configured to obtain the actual current value transmitted by the current detector. The actual current value corresponds to the target color channel in the AMOLED display panel at the second moment. The comparator is configured to compare the actual current value with the theoretical current value. If the actual current value is greater than the theoretical current value, the controller is configured to obtain the target voltage value corresponding to the target proportion of the second proportion group. The target proportion corresponds to the target color channel. The controller is further configured to adjust the driving voltage provided by the PMIC power supply to the target drive voltage, so as to drive the AMOLED display panel to operate according to the target drive voltage. According to the proportion of each of color channels in the display images of the AMOLED display panel, the driving voltage provided by the PMIC power supply may be adjusted. Such that the display brightness of the AMOLED display panel may be adjusted according to the display content, and the problem of fast wear of the OLEDs of the bright-state area due to the over brightness of the bright-state areas resulting from too many dark-state areas in some of the display images may be avoided. So as to reduce the power consuming of the display devices, and to prevent the display devices from burning due to the over brightness of the bright-state area.

DETAILED DESCRIPTION

To clarify the purpose, technical solutions, and the advantages of the disclosure, embodiments of the invention will now be described more fully hereinafter with reference to the accompanying drawings, in which embodiments of the invention are shown. The figure and the embodiment described according to figure are only for illustration, and the present disclosure is not limited to these embodiments.

It should be noted that the relational terms herein, such as "first" and "second", are used only for differentiating one entity or operation, from another entity or operation, which, however do not necessarily require or imply that there should be any real relationship or sequence. Moreover, the terms "comprise", "include" or any other variations thereof are meant to cover non-exclusive including, so that the process, method, article or device comprising a series of elements do not only comprise those elements, but also comprise other elements that are not explicitly listed or also comprise the inherent elements of the process, method, article or device. In the case that there are no more restrictions, an element qualified by the statement "comprises a . . . " does not exclude the presence of additional identical elements in the process, method, article or device that comprises the said element.

References herein to "embodiment" indicate that a particular feature, structure, or characteristic be included in at least one embodiment of the present disclosure. The appearances of phrases in various places in the specification are not necessarily all referring to the same embodiment, nor are separate or alternative embodiments mutually exclusive of other embodiments. Those skilled in the art will directly and implicitly understand that the embodiments described herein can be combined with other embodiments.

Figure 1A:
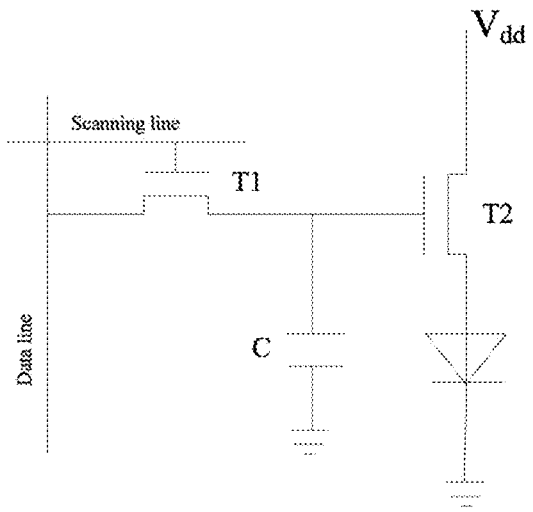
FIG. 1*a* is a circuit diagram illustrating a driving circuit of one sub-pixel of an active matrix organic light-emitting diode (AMOLED) display panel in accordance with one embodiment of the present disclosure.

Referring to FIG. 1*a*, FIG. 1*a* is a circuit diagram illustrating a driving circuit of one sub-pixel of an active matrix organic light-emitting diode (AMOLED) display panel in accordance with one embodiment of the present disclosure. The AMOLED includes a plurality of organic light-emitting diodes (OLEDs) arranged on a substrate of an AMOLED display in array, wherein the OLED is capable of emitting one of three colors of light including red, green, and blue. A driving circuit of each of the sub-pixels on the AMOLED display screen may include: the OLED, a thin film transistor (TFT) T1, a driving TFT T2, and a storage capacitor "C". A gate of the TFT T1 connects to a scanning line to receive scanning signals, and the TFT T1 may be turned on or turned off by controlling the scanning signals. A drain of the TFT T1connects to a data line to receive data signals. When the TFT T1 is turned on by the scanning signals, the data signals may be transmitted from the drain of the TFT T1 to a source of the TFT T1. A gate of the driving TFT T2 connects to the source of the TFT T1, a drain of the driving TFT T2 connects to a power management integral circuit (PMIC) power supply, and a source of the driving TFT T2 connects a positive electrode of the OLED. A negative electrode of the OLED connects to a ground Va. When the TFT T1 is turned on, the driving TFT T2 is configured to receive the data signals to drive the OLED. One end of the storage capacitor "C" connects to the gate of the driving TFT T2, and the other end of the storage capacitor "C" is grounded.

Figure 1B:
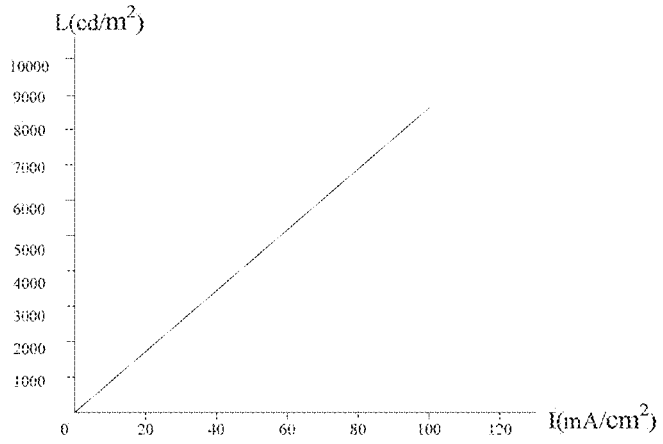
FIG. 1*b* is a diagram illustrating a relation between a luminous brightness and a luminous current of an OLED in accordance with one embodiment of the present disclosure.

As shown in FIG. 1*b*, FIG. 1*b* is a diagram illustrating a relation between a luminous brightness and a luminous current of the OLED in accordance with one embodiment of the present disclosure. The AMOLED is of a current-driven type, that is, the OLED may emit light when current passes through. According to the relation between a luminous efficiency, and the luminous current and the luminous brightness, it can be known that the luminous efficiency is a fixed value depending on luminous material, and the luminous brightness of the AMOLED is mainly determined by the luminous current passing through the OLED. According to the driving circuit, the luminous current relates to a driving voltage, that is, the driving voltage may affect the luminous current of the OLED.

Figure 1C:
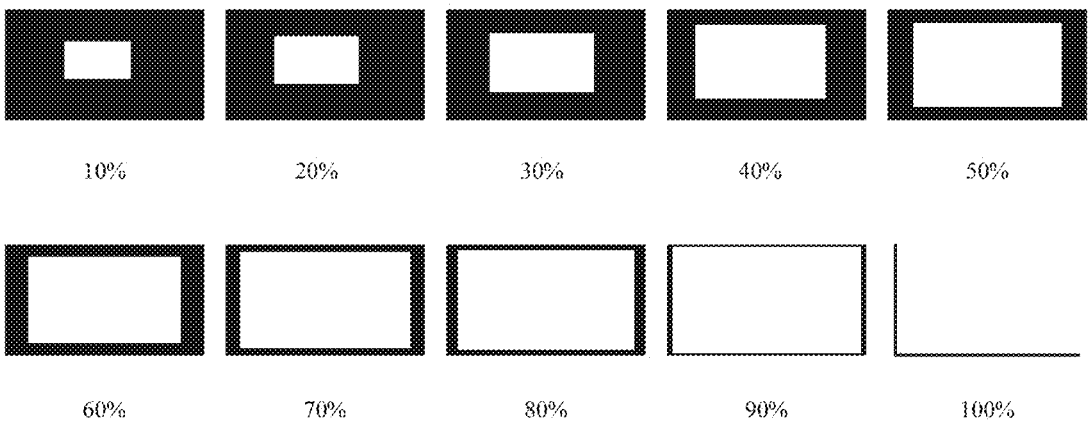
FIG. 1*c* is a diagram illustrating a displaying performance corresponding to images of different pixel ratios of a AMOLED display panel in accordance with one embodiment of the present disclosure.

As shown in FIG. 1*c*, FIG. 1*c* is a diagram illustrating a displaying performance corresponding to images of different pixel ratios of a AMOLED display panel in accordance with one embodiment of the present disclosure. When a grayscale value is equal to 255, the pixel appears in white. When the grayscale is equal to 0, the pixel appears in black. When ratios of the white image with respect to an entire screen is in a range from 10% to 100%, a brightness distribution of a central point of the display image is shown in the Table 1 below.

TABLE 1

| Proportion of white image (%) | 10% | 20% | 30% | 40% | 50% | 60% | 70% | 80% | 90% | 100% |
|---|---|---|---|---|---|---|---|---|---|---|
| Brightness of central point of screen(nits) | 630 | 585 | 553 | 522 | 492 | 468 | 450 | 427 | 415 | 400 |

When the PMIC power supply outputs the same voltage and the same data signals, an area of the white image is smaller than an entire display area, and the luminous brightness of the central point is higher. When the proportion of the white image area to the entire display area is 10%, the luminous brightness of the central point of the display screen is the highest. When the AMOLED display device displays dark-state (low brightness) images, the AMOLED display device may consume a lower luminous current value. An equivalent resistance in the display panel become larger. A resistance of peripheral circuits does not change. A voltage drop of the circuit becomes smaller. As such, the driving voltage received by the OLED may increase. When the data voltage of the OLED is a constant, the luminous current and the luminous brightness may increase. Therefore, when the PMIC power supply outputs the same driving voltage, bright-state areas may become even brighter under the dark-state images. However, the AMOLED display device does not require this high brightness, which may result in an unnecessary power consuming, and may increase a risk of burning in the bright-state areas. The present disclosure relates to a driving method of an AMOLED display panel and a display device capable of adjusting the driving voltage of the AMOLED display panel and capable of reducing the power consuming of the AMOLED display device. As such, fast wear of the OLEDs of the bright-state area due to the over brightness of the bright-state areas resulting from too many dark-state areas in the display screen may be avoided.

Figure 1D:
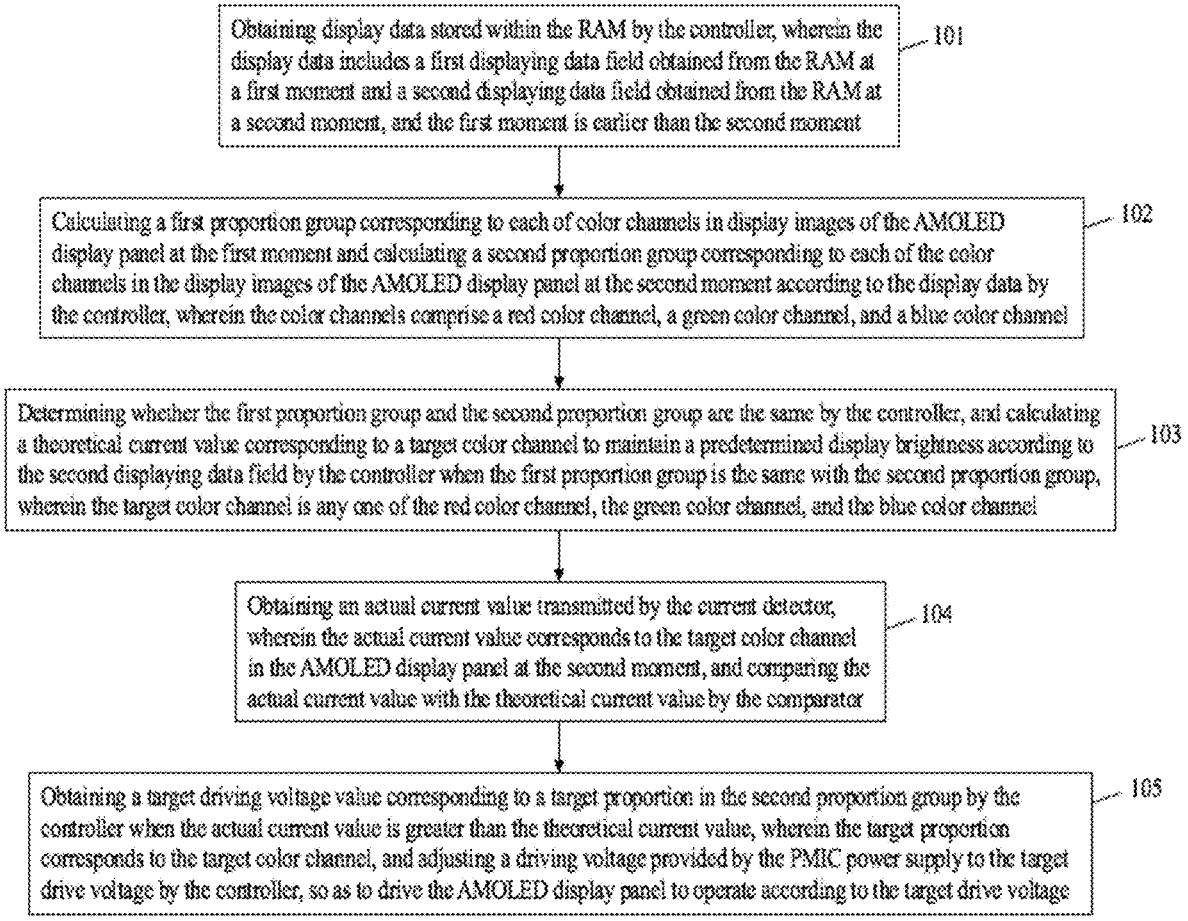
FIG. 1*d* is a flowchart illustrating a driving method of an AMOLED display panel in accordance with one embodiment of the present disclosure.

Referring to FIG. 1*d*, FIG. 1*d* is a flowchart illustrating a driving method of an AMOLED display panel in accordance with one embodiment of the present disclosure. The present disclosure relates to the driving method of the AMOLED display panel and the display device. The driving device includes a controller including at least one random access memory (RAM) and a comparator, a current detector, a PMIC power supply, and the AMOLED display panel. The driving method includes the following steps.

In step 101, obtaining display data stored within the RAM by the controller, wherein the display data includes a first displaying data field obtained from the RAM at a first moment and a second displaying data field obtained from the RAM at a second moment, and the first moment is earlier than the second moment.

In one example, when the AMOLED displays images, the display data on the display screen at any moment may be stored into the RAM. Displaying images may include "N" number of the pixels displaying in different colors, wherein "N" is an integral greater than 1. Each of the pixels may include at least one red-colored sub-pixel, at least one green colored sub-pixels, and at least one blue colored sub-pixel.

The display data may include the grayscale values of the "N" number of the pixels in the display images at any moment.

In one example, a predetermined time period "T" may be configured. The controller is configured to obtain the first displaying data field within the RAM at the first moment, and the second displaying data field within the RAM at the second moment. The first moment is earlier than the second moment. A time interval between the first moment and the second moment is configured to be the predetermined time period "T". The predetermined time period "T" may be set in a system by default or may be set by users. For example, the predetermined time period "T" may be 5 seconds or 7 seconds.

In step 102, calculating a first proportion group corresponding to each of color channels in display images of the AMOLED display panel at the first moment and calculating a second proportion group corresponding to each of the color channels in the display images of the AMOLED display panel at the second moment according to the display data by the controller, wherein the color channels comprise a red color channel, a green color channel, and a blue color channel.

In one example, the controller may determine whether the proportion corresponding to each of the color channels has changed. When the proportion corresponding to each of the color channels has changed, the driving voltage is maintained to be the same. When the proportion corresponding to each of the color channels has not been changed, the driving voltage may require to be adjusted. The proportion corresponding to each of the color channels has not been changed, which indicates the proportions of the red color channel, the green color channel, and the blue color channel have not been changed.

In one example, the step of determining whether the proportion corresponding to each of the color channels is changed may be achieved by determining whether the first proportion group and the second proportion group are the same.

The step of calculating the first proportion group corresponding to each of the color channels in the display images of the AMOLED display panel at the first moment, and the second proportion group corresponding to each of the color channels in the display images of the AMOLED display panel at the second moment according to the display data by the controller in the step 102 may further includes the following steps.

In step 21, calculating the first proportion group according to the first displaying data field.

In step 22, calculating the second proportion group according to the second displaying data field.

In one example, the first displaying data field may include a first grayscale group of each of the color channels within each of the pixels of the "N" number of the pixels of the display images at the first moment. The second displaying data field may include a second grayscale group of each of the color channels within each of the pixels of the "N" number of the pixels of the display images at the second moment.

In one example, the display data may include the grayscale values of each of the color channels within each of pixels of "N" number of the pixels in the display images of the AMOLED display panel, wherein "N" is an integral greater than 1. The step of calculating the first proportion group according to the first displaying data field further includes: calculating the first proportion group by the equation below.

$$R = \frac{R_n}{R_n + G_n + B_n},\ G = \frac{G_n}{R_n + G_n + B_n},\ B = \frac{B_n}{R_n + G_n + B_n}, \tag{1}$$

"R" indicates a first proportion corresponding to the red color channel, "G" indicates a second proportion corresponding to the green color channel, and "B" indicates a third proportion corresponding to the blue color channel. "$R_n$" indicates a summation of the grayscale values of the red color of the "N" number of the pixels, "$G_n$" indicates a summation of the grayscale values of the green color of the "N" number of the pixels, and "$B_n$" indicates a summation of the grayscale values of the blue color of the "N" number of the pixels.

The step of calculating the second proportion group according to the second displaying data field is same with step of calculating the first proportion group according to the first displaying data field.

For example, the "N" number of the pixels are configured on the AMOLED display screen, the grayscale values of each of the pixels stored within the RAM may be shown in the Table 2 below.

TABLE 2

| | First pixel | | | Second pixel | | | Third pixel | | | . . . | (n-th) pixel | | |
|---|---|---|---|---|---|---|---|---|---|---|---|---|---|
| | Red | Green | Blue | Red | Green | Blue | Red | Green | Blue | . . . | Red | Green | Blue |
| First moment | 50 | 70 | 150 | 200 | 100 | 60 | 70 | 80 | 100 | . . . | 250 | 120 | 100 |
| Second moment | 70 | 80 | 200 | 150 | 100 | 50 | 150 | 60 | 80 | . . . | 200 | 130 | 80 |

The summation of the grayscale values of each of the colors of the "N" number of the pixels in the display images at the first moment and the second moment are shown in the Table 3 below.

TABLE 3

| | | |
|---|---|---|
| First moment | Summation of the grayscale values of the red color of the "N" number of the pixels | 50 + 200 + 70 + . . . + 250 |
| | Summation of the grayscale values of the green color of the "N" number of the pixels | 70 + 100 + 80 + . . . + 120 |
| | Summation of the gray scale values of the blue color of the "N" number of the pixels | 150 + 60 + 100 + . . . + 100 |
| Second moment | Summation of the grayscale values of the red color of the "N" number of the pixels | 70 + 150 + 150 + . . . + 200 |
| | Summation of the grayscale values of the green color of the "N" number of the pixels | 80 + 100 + 60 + . . . + 130 |

TABLE 3-continued

| | |
|---|---|
| Summation of the gray scale values of the blue color of the "N" number of the pixels | 200 + 50 + 80 + . . . + 80 |

In step 103, determining whether the first proportion group and the second proportion group are the same by the controller, and calculating a theoretical current value corresponding to a target color channel to maintain a predetermined display brightness according to the second displaying data field by the controller when the first proportion group is the same with the second proportion group, wherein the target color channel is any one of the red color channel, the green color channel, and the blue color channel.

In one example, the theoretical current value may include the theoretical current value of a summation current value of any of the color channels including the red color channel, the green color channel, and the blue color channel.

The step of determining whether the first proportion group and the second proportion group are the same may include: determining whether the first proportion corresponding to the red color channel of the display images at the first moment is the same with the fourth proportion corresponding to the red color channel of the display images at the second moment, determining whether the second proportion corresponding to the green color channel of the display images at the first moment is the same with the fifth proportion corresponding to the green color channel of the display images at the second moment, and determining whether the third proportion corresponding to the blue color channel of the display images at the first moment is the same with the sixth proportion corresponding to the blue color channel of the display images at the second moment. When the first proportion is the same with the fourth proportion, the second proportion is the same with the fifth proportion, and the third proportion is the same with the sixth proportion, it is determined that the first proportion group is the same with the second proportion group.

In one example, the step of calculating a theoretical current value corresponding to a target color channel to maintain a predetermined display brightness according to the second displaying data field by the controller further includes the following steps.

In step 31, determining a predetermined display brightness corresponding to the second displaying data field.

In step 32, calculating the theoretical current value according to the predetermined display brightness and a predetermined luminous efficiency.

In one example, the second display data field may include the grayscale values of each of the pixels of the display images at the second moment. A first predetermined displaying brightness of all of the red-colored sub-pixels may be determined according to the grayscale value of all the sub-pixels corresponding to the red color channel. A second predetermined displaying brightness of all of the green-colored sub-pixels may be determined according to the grayscale value of all the sub-pixels corresponding to the green color channel. A third predetermined displaying brightness of all of the blue-colored sub-pixels may be determined according to the grayscale value of all the sub-pixels corresponding to the blue color channel. The theoretical current value may be calculated according to the following formula.

$$\text{Luminous efficiency}=\text{Luminous energy}/\text{Power consuming} \quad (2)$$

Specifically, when a target proportion is the second proportion, the fourth proportion, and the sixth proportion, the corresponding theoretical current values are shown in the Table 4 below.

TABLE 4

| | |
|---|---|
| First theoretical current value corresponding to red-colored sub-pixel | $I_R = u_1L(R)$ |
| Second theoretical current value corresponding to green-colored sub-pixel | $I_G = u_2L(G)$ |
| Third theoretical current value corresponding to blue-colored sub-pixel | $I_B = u_3L(B)$ |

"$u_1$", "$u_2$", and "$u_3$" respectively indicates reciprocals of the luminous efficiency corresponding to each of the color channels. "L(R)", "L(G)", and "L(B)" respectively indicates the first predetermined displaying brightness, the second predetermined displaying brightness, and the third predetermined displaying brightness.

In step 104, obtaining an actual current value transmitted by the current detector, wherein the actual current value corresponds to the target color channel in the AMOLED display panel at the second moment, and comparing the actual current value with the theoretical current value by the comparator.

In one example, the actual current value corresponding to the target color channel of the AMOLED display panel at the second moment may be detected by the current detector. The actual current value may include the actual current consumed by all of the sub-pixels of any of the red color channel, the green color channel, and the blue color channel.

In step 105, obtaining a target driving voltage value corresponding to a target proportion in the second proportion group by the controller when the actual current value is greater than the theoretical current value, wherein the target proportion corresponds to the target color channel, and adjusting a driving voltage provided by the PMIC power supply to the target drive voltage by the controller, so as to drive the AMOLED display panel to operate according to the target drive voltage.

In one example, when the actual current value is greater than the theoretical current value, the problem of over brightness may occur in the bright-state areas. The driving circuit of the present disclosure may be capable of adjusting the driving voltage to reduce the current passing through the AMOLED display panel and to reduce the unnecessary power consuming.

The second proportion group corresponding to each of the color channels of the display images at the second moment may include: the fourth proportion corresponding to the red color channel, the fifth proportion corresponding to the green color channel, and the sixth proportion corresponding to the blue color channel. The target proportion may be any one of the fourth proportion, the fifth proportion, and the sixth proportion.

The step of obtaining a target driving voltage value corresponding to a target proportion in the second proportion group by the controller further includes: searching a first voltage value corresponding to the target proportion from a predetermined driving voltage mapping table.

The driving current value of the target proportion corresponding to different color channels may be collected in advance to establish the driving voltage mapping table. Specifically, a "K" number of the driving voltage values of the target proportion corresponding to the "K" number of the channels of different colors is collected, wherein "K" is an integral greater than 1. As such, the target driving value may be obtained according to the target proportion.

In view of the above, the controller is configured to obtain the display data stored within the RAM. The display data may include the first displaying data field obtained from the RAM at the first moment and the second displaying data field obtained from the RAM at the second moment. The first moment is earlier than the second moment. The controller is configured to calculate the first proportion group corresponding to each of the color channels in the display images of the AMOLED display panel at the first moment and the second proportion group corresponding to each of the color channels in the display images of the AMOLED display panel at the second moment according to the display data. The color channels may include the red color channel, the green color channel, and the blue color channel. The controller is configured to determine whether the first proportion group and the second proportion group are the same. If the first proportion group is the same with the second proportion group, it may indicate that the proportion of each of the color channels in the display images of the AMOLED display panel has not been changed during the specified time period. The controller is configured to calculate the theoretical current value corresponding to the target color channel to maintain the predetermined display brightness according to the second displaying data field. The target color channel may be any one of the red color channel, the green color channel, and the blue color channel. The controller is configured to obtain the actual current value transmitted by the current detector. The actual current value corresponds to the target color channel in the AMOLED display panel at the second moment. The comparator is configured to compare the actual current value with the theoretical current value. If the actual current value is greater than the theoretical current value, the controller is configured to obtain the target voltage value corresponding to the target proportion of the second proportion group. The target proportion corresponds to the target color channel. The controller is further configured to adjust the driving voltage provided by the PMIC power supply to the target drive voltage, so as to drive the AMOLED display panel to operate according to the target drive voltage. Such that the theoretical current value required by the display screen may be calculated. The actual current value may be detected by the current detector. According to the proportion of each of color channels in the display images of the AMOLED display panel, the driving voltage outputted by the PMIC power supply may be adjusted. As such, the display brightness of the AMOLED display panel may be adjusted according to the display content, the display performance may not be affected, the power consuming may be reduced by reducing the driving voltage, and the problem of fast wear of the OLEDs of the bright-state area due to the over brightness of the bright-state resulting from too many dark-state areas in some of the display images may be avoided. So as to reduce a risk of burning at the bright-state areas due to the over brightness.

Figure 2:
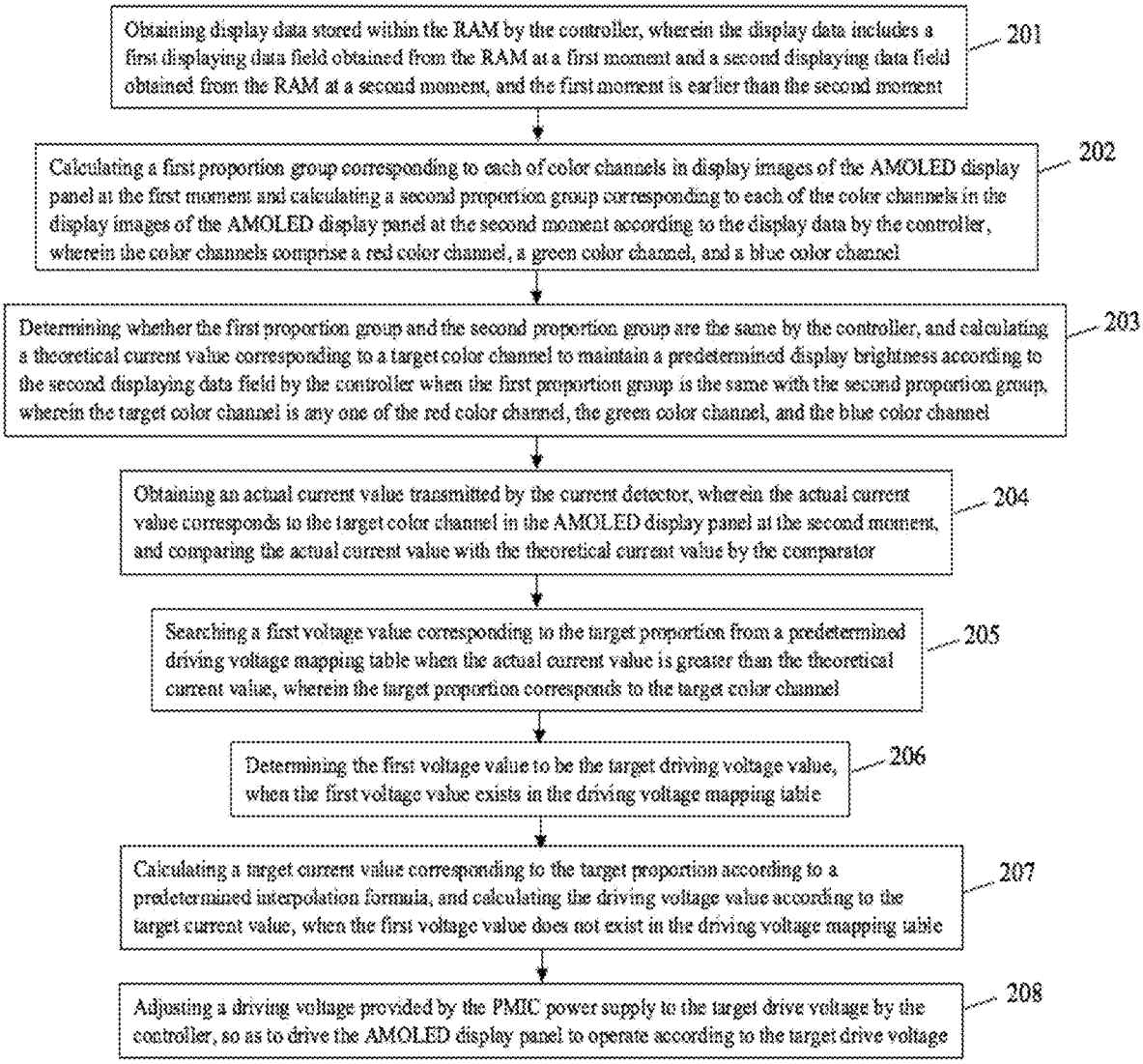
FIG. 2 is a flowchart illustrating a driving method of an AMOLED display panel in accordance with another embodiment of the present disclosure.

Referring to FIG. 2, FIG. 2 a flowchart illustrating a driving method of an AMOLED display panel in accordance with another embodiment of the present disclosure. The driving method of the AMOLED display panel is adopted in the display device of the AMOLED display panel. The driving device includes the controller including the at least one RAM and the comparator, the current detector, the PMIC power supply, and the AMOLED display panel. The driving method includes the following steps.

In step 201, obtaining display data stored within the RAM by the controller, wherein the display data includes a first displaying data field obtained from the RAM at a first moment and a second displaying data field obtained from the RAM at a second moment, and the first moment is earlier than the second moment.

In step 202, calculating a first proportion group corresponding to each of color channels in display images of the AMOLED display panel at the first moment and calculating a second proportion group corresponding to each of the color channels in the display images of the AMOLED display panel at the second moment according to the display data by the controller, wherein the color channels includes a red color channel, a green color channel, and a blue color channel.

In step 203, determining whether the first proportion group and the second proportion group are the same by the controller, and calculating a theoretical current value corresponding to a target color channel to maintain a predetermined display brightness according to the second displaying data field by the controller when the first proportion group is the same with the second proportion group, wherein the target color channel is any one of the red color channel, the green color channel, and the blue color channel.

In step 204, obtaining an actual current value transmitted by the current detector, wherein the actual current value corresponds to the target color channel in the AMOLED display panel at the second moment, and comparing the actual current value with the theoretical current value by the comparator.

In step 205, searching a first voltage value corresponding to the target proportion from a predetermined driving voltage mapping table when the actual current value is greater than the theoretical current value, wherein the target proportion corresponds to the target color channel.

In one example, the predetermined driving voltage mapping table is established according to the "K" number of the driving voltages, and the "K" number of the driving voltages correspond to the target proportion being calculated in advance. "K" is an integral greater than 1. If "K" is greater than "P" the number of the driving voltage value related to the driving voltage mapping table is greater than the number of driving voltage, which indicates that it is easier to obtain the first voltage value corresponding to the target proportion from the driving voltage mapping table.

In step 206, determining the first voltage value to be the target driving voltage value, when the first voltage value exists in the driving voltage mapping table.

In one example, if the first voltage value corresponding to the target proportion of the second proportion group exists in the driving voltage mapping table, the first voltage value may be directly determined to be the target voltage value. As such, the target driving voltage value may be obtained accurately.

In step 207, calculating a target current value corresponding to the target proportion according to a predetermined interpolation formula, and calculating the driving voltage value according to the target current value, when the first voltage value does not exist in the driving voltage mapping table.

In one example, if the first voltage value does not exist in the driving voltage mapping table, the target driving voltage value may not be determined by searching the driving voltage mapping table. Otherwise, the target current value corresponding to the target proportion may be calculated by the interpolation formula.

For example, the "P" number of the target current value of the target proportion corresponding to the "P" number of different color channels may be counted in advanced. "P" is an integral greater than 1. The "P" number of the target current value may include the target current value "x" and the target current value "y". Assuming a range of the target proportion "m" is from "a" to "b", wherein "a" corresponds to the target current value "x", and "b" corresponds to the target current value "y". The target current value "i" may be calculated by the following interpolation formula.

$$i = \frac{(y-x)(m-a)}{b-a} + x \tag{3}$$

Assuming a range of the target proportion "m" is from "0" to "a", wherein "a" corresponds to the target current value "x". The target current value "i" may be calculated by the following interpolation formula.

$$i = \frac{(x-0)(m-0)}{a-0} + 0 \tag{4}$$

Assuming the target proportion "m" is greater than "b", wherein "b" corresponds to the target current value "y". The target current value "i" may be calculated by the following interpolation formula.

$$i = \frac{(0-y)(m-b)}{0-b} + y \tag{5}$$

After the target current value is calculated, the target driving current value "i" may be obtained by the following formula.

$$i=k(v_{elvdd}-v_{data}-v_{th})^2 \tag{6}$$

$v_{elvdd}$ is the driving voltage, vim is a predetermined data voltage, $v_{th}$ is a predetermined threshold voltage, and "k" is a predetermined current coefficient.

In step 208, adjusting a driving voltage provided by the PMIC power supply to the target drive voltage by the controller, so as to drive the AMOLED display panel to operate according to the target drive voltage.

In view of the above, the controller is configured to obtain the display data stored within the RAM. The display data may include the first displaying data field obtained from the RAM at the first moment and the second displaying data field obtained from the RAM at the second moment. The first moment is earlier than the second moment. The controller is configured to calculate the first proportion group corresponding to each of the color channels in the display images of the AMOLED display panel at the first moment and the second proportion group corresponding to each of the color channels in the display images of the AMOLED display panel at the second moment according to the display data. The color channels may include the red color channel, the green color channel, and the blue color channel. The controller is configured to determine whether the first proportion group and the second proportion group are the same. If the first proportion group is the same with the second proportion group, it may indicate that the proportion of each of the color channels in the display images of the AMOLED display panel has not been changed during the specified time period. The controller is configured to calculate the theoretical current value corresponding to the target color channel to maintain the predetermined display brightness according to the second displaying data field. The target color channel may be any one of the red color channel, the green color channel, and the blue color channel. The controller is configured to obtain the actual current value transmitted by the current detector. The actual current value corresponds to the target color channel in the AMOLED display panel at the second moment. The comparator is configured to compare the actual current value with the theoretical current value. The controller is configured to search the first voltage value corresponding to the target proportion from the predetermined driving voltage mapping table when the actual current value is greater than the theoretical current value, wherein the target proportion corresponds to the target color channel. The controller is configured to determine the first voltage value to be the target driving voltage value when the first voltage value exists in the driving voltage mapping table. The controller is configured to calculate the target current value corresponding to the target proportion according to the predetermined interpolation formula, and calculating the driving voltage value according to the target current value, when the first voltage value does not exist in the driving voltage mapping table. The controller is further configured to adjust the driving voltage provided by the PMIC power supply to the target drive voltage, so as to drive the AMOLED display panel to operate according to the target drive voltage. Such that the theoretical current value required by the display screen may be calculated. The actual current value may be detected by the current detector. According to the proportion of each of color channels in the display images of the AMOLED display panel, the driving voltage outputted by the PMIC power supply may be adjusted. As such, the display brightness of the AMOLED display panel may be adjusted according to the display content, the display performance may not be affected, the power consuming may be reduced by reducing the driving voltage, and the problem of fast wear of the OLEDs of the bright-state area due to the over brightness of the bright-state resulting from too many dark-state areas in some of the display images may be avoided. So as to reduce a risk of burning at the bright-state areas due to the over brightness.

Figure 3A:
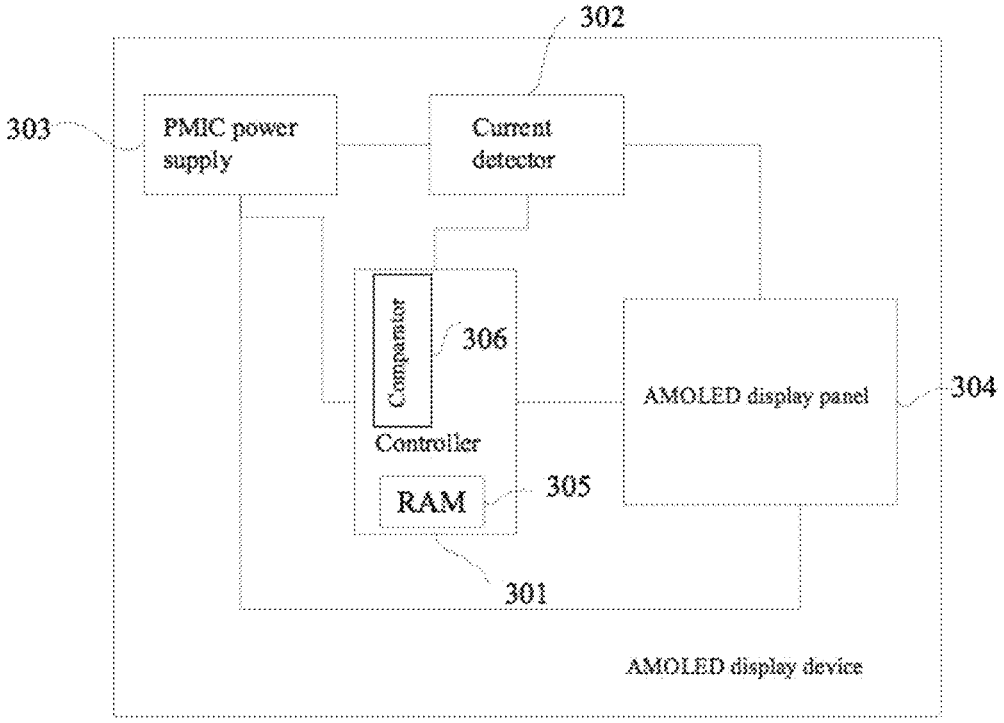
FIG. 3*a* is a schematic view of a driving device of an AMOLED display panel in accordance with one embodiment of the present disclosure

Referring to FIG. 3*a*, FIG. 3*a* is a schematic view of a driving device of an AMOLED display panel in accordance with one embodiment of the present disclosure. The driving device of the AMOLED display panel may include: the controller 301 including the at least one RAM 305 and the comparator 306, the current detector 302, the PMIC power supply 303, and the AMOLED display panel 304. The controller 301 connects to the current detector 302, the PMIC power supply 303, and the AMOLED display panel 304. The current detector 302 connects to the PMIC power supply 303 and the AMOLED display panel 304. The PMIC power supply 303 connects to the AMOLED display panel 304. The RAM 305 connects to the AMOLED display panel 304. The comparator 306 connects to the current detector 302.

The RAM 305 is configured to store the display data of the display images of the AMOLED display panel. The display data includes the first displaying data field obtained from the RAM at the first moment and the second displaying data field obtained from the RAM at the second moment. The first moment is earlier than the second moment.

The controller 301 is further configured to obtain the display data stored within the RAM. The controller is further configured to calculate the first proportion group corresponding to each of the color channels in the display images of the AMOLED display panel at the first moment and the second proportion group corresponding to each of the color channels in the display images of the AMOLED display panel at the second moment according to the display data. The color channels include the red color channel, the green color channel, and the blue color channel.

The controller 301 is further configured to determine whether the first proportion group and the second proportion group are the same. If the first proportion group is the same with the second proportion group, the controller is configured to calculate the theoretical current value corresponding to the target color channel to maintain the predetermined display brightness according to the second displaying data field, wherein the target color channel is any one of the red color channel, the green color channel, and the blue color channel.

The current detector 302 is configured to detect the actual current value corresponding to the target color channel in the AMOLED display panel at the second moment.

The comparator 306 is configured to compare the actual current value with the theoretical current value.

If the actual current value is greater than the theoretical current value, the controller 301 is configured to obtain the target driving voltage value corresponding to the target proportion in the second proportion group, wherein the target proportion corresponds to the target color channel. The controller 301 is further configured to adjust the driving voltage provided by the PMIC power supply to the target drive voltage, so as to drive the AMOLED display panel to operate according to the target drive voltage.

The PMIC power supply 303 is configured to provide the driving voltage.

Figure 3B:
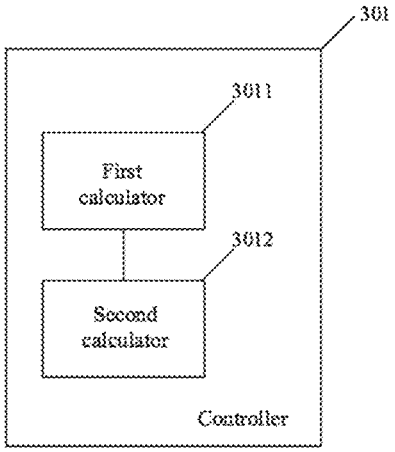
FIG. 3*b* is a schematic view of a controller 301 of a driving device of an AMOLED display panel in accordance with one embodiment of the present disclosure.

As shown in FIG. 3*b*, FIG. 3*b* is a schematic view of the controller 301 of the driving device of the AMOLED display panel in accordance with one embodiment of the present disclosure. The controller 301 may include a first calculator 3011 and a second calculator 3012.

The first calculator 3011 is configured to calculate the first proportion group according to the first displaying data field.

The second calculator 3012 is configured to calculate the second proportion group according to the second displaying data field.

The display data includes the grayscale values of each of the color channels within each of pixels of "N" number of the pixels in the display images of the AMOLED display panel, wherein "N" is an integral greater than 1. The first calculator 3011 is further configured to calculate the first proportion group by the equation below:

$$R = \frac{R_n}{R_n + G_n + B_n},\ G = \frac{G_n}{R_n + G_n + B_n},\ B = \frac{B_n}{R_n + G_n + B_n}, \tag{7}$$

"R" indicates the first proportion corresponding to the red color channel, "G" indicates the second proportion corresponding to the green color channel, and "B" indicates the third proportion corresponding to the blue color channel. "$R_n$" indicates the summation of the grayscale values of the red color of the "N" number of the pixels, "$G_n$" indicates the summation of the grayscale values of the green color of the "N" number of the pixels, and "$B_n$" indicates the summation of the grayscale values of the blue color of the "N" number of the pixels.

Figure 3C:
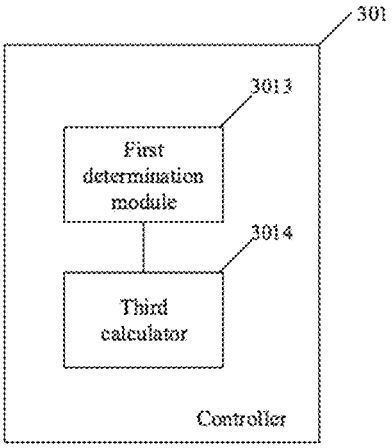
FIG. 3*c* is a schematic view of the controller 301 of the driving device of the AMOLED display panel in accordance with another embodiment of the present disclosure.

As shown in FIG. 3*c*, FIG. 3*c* is a schematic view of the controller 301 of the driving device of the AMOLED display panel in accordance with another embodiment of the present disclosure. The controller 301 may include a determination module 3013 and a third calculator 3014.

The first determination module 3013 is configured to determine the predetermined display brightness corresponding to the second displaying data field.

The third calculator 3014 is configured to calculate the theoretical current value according to the predetermined display brightness and the predetermined luminous efficiency.

Figure 3D:
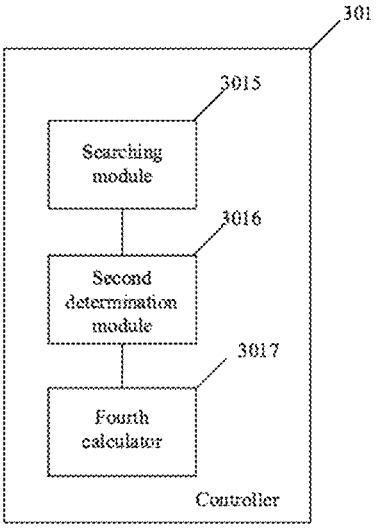
FIG. 3*d* is a schematic view of the controller 301 of the driving device of the AMOLED display panel in accordance with another embodiment of the present disclosure.

As shown in FIG. 3*d*, FIG. 3*d* is a schematic view of the controller 301 of the driving device of the AMOLED display panel in accordance with another embodiment of the present disclosure. The controller 301 may include a searching module 3015, a second determination module 3016, and a fourth calculator 3017.

The searching module 3015 is configured to search the first voltage value corresponding to the target proportion from the predetermined driving voltage mapping table.

The second determining module 3016 is configured to determine the first voltage value is the target driving voltage value, when the first voltage value exists in the driving voltage mapping table.

The fourth calculator 3017 is configured to calculate the target current value corresponding to the target proportion, and to calculate the driving voltage value according to the target current value according to the predetermined interpolation formula, when the first voltage value does not exist in the driving voltage mapping table.

In view of the above, the controller is configured to obtain the display data stored within the RAM. The display data may include the first displaying data field obtained from the RAM at the first moment and the second displaying data field obtained from the RAM at the second moment. The first moment is earlier than the second moment. The controller is configured to calculate the first proportion group corresponding to each of the color channels in the display images of the AMOLED display panel at the first moment and the second proportion group corresponding to each of the color channels in the display images of the AMOLED display panel at the second moment according to the display data. The color channels may include the red color channel, the green color channel, and the blue color channel. The controller is configured to determine whether the first proportion group and the second proportion group are the same. If the first proportion group is the same with the second proportion group, it may indicate that the proportion of each of the color channels in the display images of the AMOLED display panel has not been changed during the specified time period. The controller is configured to calculate a theoretical current value corresponding to a target color channel to maintain a predetermined display brightness according to the second displaying data field. The target color channel may be any one of the red color channel, the green color channel, and the blue color channel. The controller is configured to obtain the actual current value transmitted by the current detector. The actual current value corresponds to the target color channel in the AMOLED display panel at the second moment. The comparator is configured to compare the actual current value with the theoretical current value. The controller is configured to search the first voltage value corresponding to the target proportion from the predetermined driving voltage mapping table when the actual current value is greater than the theoretical current value, wherein the target proportion corresponds to the target color channel. The controller is configured to determine the first voltage value to be the target driving voltage value when the first voltage value exists in the driving voltage mapping table. The controller is configured to calculate the target current value corresponding to the target proportion according to the predetermined interpolation formula, and calculating the driving voltage value according to the target current value, when the first voltage value does not exist in the driving voltage mapping table. The controller is further configured to adjust the driving voltage provided by the PMIC power supply to the target drive voltage, so as to drive the AMOLED display panel to operate according to the target drive voltage. Such that the theoretical current value required by the display screen may be calculated. The actual current value may be detected by the current detector. According to the proportion of each of color channels in the display images of the AMOLED display panel, the driving voltage outputted by the PMIC power supply may be adjusted. As such, the display brightness of the AMOLED display panel may be adjusted according to the display content, the display performance may not be affected, the power consuming may be reduced by reducing the driving voltage, and the problem of fast wear of the OLEDs of the bright-state area due to the over brightness of the bright-state resulting from too many dark-state areas in some of the display images may be avoided. So as to reduce a risk of burning at the bright-state area due to the over brightness.

It can be understood that, in order to realize the above functions, the driving device of the AMOLED display panel includes a corresponding hardware structure and/or software module for executing each function. Those skilled in the art should readily appreciate that the present disclosure can be implemented in hardware or a combination of hardware and computer software, in combination with the exemplary units and algorithm steps described in the embodiments disclosed herein. Whether a certain function is implemented by means of hardware or computer software driving hardware depends on the specific application and design constraint conditions of the technical solution. A person skilled in the art may use different methods to implement the described functions for each specific application, but such implementation should not be considered to go beyond the scope of the present disclosure.

The embodiment of the present disclosure may perform division of functional units of the driving apparatus of the AMOLED display panel according to the above examples. For example, each function unit may be divided according to the functions, and two or more functions may also be integrated in one processing unit. The above integrated unit can be implemented either in hardware or in software. It should be noted that the division of functions is schematic, and is only divided into one logical function. In actual implementation, there may be different divisions.

An embodiment of the present disclosure further provides a computer storage medium, wherein the computer storage medium stores a computer program for electronic data exchange, and the computer program causes a computer to execute a part of, or all of the methods described in the above method embodiments. The computer includes a driving device of an AMOLED display panel.

An embodiment of the present disclosure further provides a computer program product comprising a non-transitory computer-readable storage medium storing a computer program, and the computer program is operable to cause a computer to execute part of or all of the steps of the method embodiments as described above. The computer program product may be a software installation package including a drive device of an AMOLED display panel.

It should be noted that for the foregoing method embodiments, for the sake of simple description, they are all expressed as a series of action combinations, but those skilled in the art should know that the present disclosure is not affected by the sequence of actions described. This is because, according to the present disclosure, certain steps can be performed in other sequences or simultaneously. Second, those skilled in the art should also understand that the embodiments described in the specification all belong to preferred embodiments, and the involved actions and modules are not necessarily required by the present disclosure.

In the above embodiments, the description of each embodiment has its own emphasis. For the part that is not described in detail in an embodiment, reference may be made to the description of other embodiments.

In several embodiments provided by the present disclosure, it should be understood that the disclosed apparatus can be implemented in other ways. For example, the device embodiments described above are merely schematic, for example, the division of the units is only one logical function division, and actual implementation may have another division manner, for example, multiple units or components may be combined or may be Integrated into another system, or some features can be ignored or not implemented. In addition, the illustrated or discussed mutual coupling or direct coupling or communication connection may be indirect coupling or communication connection through some interfaces, devices or units, and may be electrical or other forms.

The units described as separate parts may or may not be physically separated, and parts displayed as units may or may not be physical units, that is, may be located in one place, or may be distributed to multiple networks. Some or all of the units may be selected according to actual needs to achieve the purpose of the solution of this embodiment.

In addition, each functional unit in each embodiment of the present disclosure may be integrated in one processing unit, or each unit may exist alone physically, or two or more units may be integrated in one unit. The above integrated unit can be implemented either in hardware or in software.

The integrated unit, if implemented in the form of a software functional unit and sold or used as a stand-alone product, may be stored in a computer-readable memory. Based on this understanding, the part of the technical solution of the present disclosure that essentially or contributing to the prior art or all or part of the technical solution can be embodied in the form of a software product stored in a memory. Several instructions are included to enable a computer device (which may be a personal computer, a server or a network device, etc.) to perform all or part of the steps of the method described in the various embodiments of the present disclosure. The foregoing memory includes various media that can store program codes, such as a U disk, a read-only memory (ROM), a random access memory (RAM), a removable hard disk, a magnetic disk, or an optical disk.

Those of ordinary skill in the art can understand that all or some of the various methods of the above embodiments can be accomplished by a program instructing related hardware, and the program can be stored in a computer readable memory, and the memory can include: Flash disk, read-only memory (ROM), random access memory (RAM), disk or optical disk, etc.

The above description is merely the embodiments in the present disclosure, the claim is not limited to the description thereby. The equivalent structure or changing of the process of the content of the description and the figures, or to implement to other technical field directly or indirectly should be included in the claim.

What is claimed is:

1. A driving method of an active matrix organic light-emitting diode (AMOLED) display panel configured to drive a driving device of an AMOLED display panel, the driving device comprises:

a controller comprising at least one random access memory (RAM) and a comparator, a current detector, a power management integrated circuit (PMIC) power supply, and the AMOLED display panel, the method comprising:

obtaining display data stored within the RAM by the controller, wherein the display data comprises a first displaying data field obtained from the RAM at a first moment and a second displaying data field obtained from the RAM at a second moment, and the first moment is earlier than the second moment;

calculating a first proportion group corresponding to each of color channels in display images of the AMOLED display panel at the first moment and calculating a second proportion group corresponding to each of the color channels in the display images of the AMOLED display panel at the second moment according to the display data by the controller, wherein the color channels comprise a red color channel, a green color channel, and a blue color channel;

determining whether the first proportion group and the second proportion group are the same by the controller;

calculating a theoretical current value corresponding to a target color channel to maintain a predetermined display brightness according to the second displaying data field by the controller when the first proportion group is the same with the second proportion group, wherein the target color channel is any one of the red color channel, the green color channel, and the blue color channel;

obtaining an actual current value transmitted by the current detector, wherein the actual current value corresponds to the target color channel in the AMOLED display panel at the second moment;

comparing the actual current value with the theoretical current value by the comparator:

obtaining a target driving voltage value corresponding to a target proportion in the second proportion group by the controller when the actual current value is greater than the theoretical current value, wherein the target proportion corresponds to the target color channel;

adjusting a driving voltage provided by the PMIC power supply to the target drive voltage by the controller, so as to drive the AMOLED display panel to operate according to the target drive voltage.

2. The driving method according to claim 1, wherein the step of calculating a theoretical current value corresponding to a target color channel to maintain a predetermined display brightness according to the second displaying data field by the controller further comprises:

determining a predetermined display brightness corresponding to the second displaying data field;

calculating thetheoretical current value according to the predetermined display brightness and a predetermined luminous efficiency.

3. The driving method according to claim 1, wherein the step of obtaining a target driving voltage value corresponding to a target proportion in the second proportion group by the controller further comprises:

searching a first voltage value corresponding to the target proportion from a predetermined driving voltage mapping table;

determining the first voltage value to be the target driving voltage value, when the first voltage value exists in the driving voltage mapping table;

calculating a target current value corresponding to the target proportion according to a predetermined interpolation formula, and calculating the driving voltage value according to the target current value, when the first voltage value does not exist in the driving voltage mapping table.

4. The driving method according to claim 1, wherein step of calculating a first proportion group corresponding to each of color channels in display images of the AMOLED display panel at the first moment and a second proportion group corresponding to each of the color channels in the display images of the AMOLED display panel at the second moment according to the display data by the controller further comprises:

calculating the first proportion group according to the first displaying data field;

calculating the second proportion group according to the second displaying data field.

5. The driving method according to claim 4, wherein the step of calculating a theoretical current value corresponding to a target color channel to maintain a predetermined display brightness according to the second displaying data field by the controller further comprises:

determining a predetermined display brightness corresponding to the second displaying data field;

calculating the theoretical current value according to the predetermined display brightness and a predetermined luminous efficiency.

6. The driving method according to claim 4, wherein the step of obtaining a target driving voltage value corresponding to a target proportion in the second proportion group by the controller further comprises:

searching a first voltage value corresponding to the target proportion from a predetermined driving voltage mapping table;

determining the first voltage value to be the target driving voltage value, when the first voltage value exists in the driving voltage mapping table;

calculating a target current value corresponding to the target proportion according to a predetermined interpolation formula, and calculating the driving voltage value according to the target current value, when the first voltage value does not exist in the driving voltage mapping table.

7. The driving method according to claim 4, wherein the display data comprises grayscale values of each of the color channels within each of pixels of "N" number of the pixels in the display images of the AMOLED display panel, wherein "N" is an integral greater than 1, and the step of calculating the first proportion group according to the first displaying data field further comprises:

calculating the first proportion group by equation below:

$$R=R_n/R_n+G_n+B_n, G=G_n/R_n+G_n+B_n, B=B_n/R_n+G_n+B_n;$$

wherein "R" indicates a first proportion corresponding to the red color channel, "G" indicates a second proportion corresponding to the green color channel, "B" indicates a third proportion corresponding to the blue color channel, "$R_n$" indicates a summation of the grayscale values of the red color of the "N" number of the pixels, "$G_n$" indicates a summation of the grayscale values of the green color of the "N" number of the pixels, and "$B_n$" indicates a summation of the grayscale values of the blue color of the "N" number of the pixels.

8. The driving method according to claim 7, wherein the step of obtaining a target driving voltage value corresponding to a target proportion in the second proportion group by the controller further comprises:

searching a first voltage value corresponding to the target proportion from a predetermined driving voltage mapping table;

determining the first voltage value to be the target driving voltage value, when the first voltage value exists in the driving voltage mapping table;

calculating a target current value corresponding to the target proportion according to a predetermined interpolation formula, and calculating the driving voltage value according to the target current value, when the first voltage value does not exist in the driving voltage mapping table.

9. The driving method according to claim 7, wherein the step of calculating a theoretical current value corresponding to a target color channel to maintain a predetermined display brightness according to the second displaying data field by the controller further comprises:

determining a predetermined display brightness corresponding to the second displaying data field;

calculating the theoretical current value according to the predetermined display brightness and a predetermined luminous efficiency.

10. The driving method according to claim 9, wherein the step of obtaining a target driving voltage value corresponding to a target proportion in the second proportion group by the controller further comprises:

searching a first voltage value corresponding to the target proportion from a predetermined driving voltage mapping table;

determining the first voltage value to be the target driving voltage value, when the first voltage value exists in the driving voltage mapping table:

calculating a target current value corresponding to the target proportion according to a predetermined interpolation formula, and calculating the driving voltage value according to the target current value, when the first voltage value does not exist in the driving voltage mapping table.

11. A driving device of an AMOLED display panel, comprising:

a controller comprising at least one RAM and a comparator, a current detector, a PMIC power supply, and the AMOLED display panel, wherein the controller connects to the current detector, the PMIC power supply, and the AMOLED display panel, the current detector connects to the PMIC power supply and the AMOLED display panel, the PMIC power supply connects to the AMOLED display panel, the RAM connects to the AMOLED display panel, and the comparator connects to the current detector;

wherein the RAM is configured to store display data of display images of the AMOLED display panel, the display data comprises a first displaying data field obtained from the RAM at a first moment and a second displaying data field obtained from the RAM at a second moment, and the first moment is earlier than the second moment:

the controller is configured to obtain display data stored within the RAM;

the controller is further configured to calculate a first proportion group corresponding to each of color channels in the display images of the AMOLED display panel at the first moment and a second proportion group corresponding to each of the color channels in the display images of the AMOLED display panel at the second moment according to the display data, wherein the color channels comprise a red color channel, a green color channel, and a blue color channel;

the controller is further configured to determine whether the first proportion group and the second proportion group are the same, if the first proportion group is the same with the second proportion group, the controller is configured to calculate a theoretical current value corresponding to a target color channel to maintain a predetermined display brightness according to the second displaying data field, wherein the target color channel is any one of the red color channel, the green color channel, and the blue color channel;

the current detector is configured to detect an actual current value corresponding to the target color channel in the AMOLED display panel at the second moment;

the comparator is configured to compare the actual current value with the theoretical current value;

if the actual current value is greater than the theoretical current value, the controller is configured to obtain a target driving voltage value corresponding to a target proportion in the second proportion group, wherein the target proportion corresponds to the target color channel, the controller is further configured to adjust a driving voltage provided by the PMIC power supply to the target drive voltage, so as to drive the AMOLED display panel to operate according to the target drive voltage; and the PMIC power supply is configured to provide the driving voltage.

12. The driving device according to claim 11, wherein the controller further comprises:

a first determination module configured to determine a predetermined display brightness corresponding to the second displaying data field;

a third calculator configured to calculate the theoretical current value according to the predetermined display brightness and a predetermined luminous efficiency.

13. The driving device according to claim 11, wherein the controller further comprises:

a searching module configured to search a first voltage value corresponding to the target proportion from a predetermined driving voltage mapping table;

a second determining module configured to determine the first voltage value is the target driving voltage value, when the first voltage value exists in the driving voltage mapping table;

a fourth calculator configured to calculate a target current value corresponding to the target proportion, and to calculate the driving voltage value according to the target current value according to a predetermined interpolation formula, when the first voltage value does not exist in the driving voltage mapping table.

14. The driving device according to claim 11, wherein the controller further comprises:

a first calculator configured to calculate the first proportion group according to the first displaying data field:

a second calculator configured to calculate the second proportion group according to the second displaying data field.

15. The driving device according to claim 14, wherein the controller further comprises:

a first determination module configured to determine a predetermined display brightness corresponding to the second displaying data field;

a third calculator configured to calculate the theoretical current value according to the predetermined display brightness and a predetermined luminous efficiency.

16. The driving device according to claim 14, wherein the controller further comprises:

a searching module configured to search a first voltage value corresponding to the target proportion from a predetermined driving voltage mapping table;

a second determining module configured to determine the first voltage value is the target driving voltage value, when the first voltage value exists in the driving voltage mapping table;

a fourth calculator configured to calculate a target current value corresponding to the target proportion, and to calculate the driving voltage value according to the target current value according to a predetermined interpolation formula, when the first voltage value does not exist in the driving voltage mapping table.

17. The driving device according to claim 14, wherein the display data comprises grayscale values of each of the color channels within each of pixels of "N" number of the pixels in the display images of the AMOLED display panel, wherein "N" is an integral greater than 1, and the first calculator is further configured to calculate the first proportion group by the equation below:

$$R=R_n/R_n+G_n+B_n, G=G_n/R_n+G_n+B_n, B=B_n/R_n+G_n+B_n;$$

wherein "R" indicates a first proportion corresponding to the red color channel, "G" indicates a second proportion corresponding to the green color channel, "B" indicates a third proportion corresponding to the blue color channel, "$R_n$" indicates a summation of the grayscale values of the red color of the "N" number of the pixels, "$G_n$" indicates a summation of the grayscale values of the green color of the "N" number of the pixels, and "$B_n$" indicates a summation of the grayscale values of the blue color of the "N" number of the pixels.

18. The driving device according to claim 17, wherein the controller further comprises:

a searching module configured to search a first voltage value corresponding to the target proportion from a predetermined driving voltage mapping table;

a second determining module configured to determine the first voltage value is the target driving voltage value, when the first voltage value exists in the driving voltage mapping table;

a fourth calculator configured to calculate a target current value corresponding to the target proportion, and to calculate the driving voltage value according to the target current value according to a predetermined interpolation formula, when the first voltage value does not exist in the driving voltage mapping table.

19. The driving device according to claim 17, wherein the controller further comprises:

a first determination module configured to determine a predetermined display brightness corresponding to the second displaying data field:

a third calculator configured to calculate the theoretical current value according to the predetermined display brightness and a predetermined luminous efficiency.

20. The driving device according to claim 19, wherein the controller further comprises:

a searching module configured to search a first voltage value corresponding to the target proportion from a predetermined driving voltage mapping table;

a second determining module configured to determine the first voltage value is the target driving voltage value, when the first voltage value exists in the driving voltage mapping table;

a fourth calculator configured to calculate a target current value corresponding to the target proportion, and to calculate the driving voltage value according to the target current value according to a predetermined interpolation formula, when the first voltage value does not exist in the driving voltage mapping table.

* * * * *